US005254058A

United States Patent [19]

Savigny

[11] Patent Number: 5,254,058

[45] Date of Patent: Oct. 19, 1993

[54] ARTIFICIAL CLIMBING WALL WITH MODULAR ROUGH SURFACE

[75] Inventor: François Savigny, Le Touvet, France

[73] Assignee: Entre-Prises S.A., Le Touvet, France

[21] Appl. No.: 769,230

[22] Filed: Oct. 1, 1991

[30] Foreign Application Priority Data

Oct. 15, 1990 [FR] France ..... 90 13013

[51] Int. Cl.[5] ..... A63B 7/04

[52] U.S. Cl. ..... 482/37; 482/35; 482/908

[58] Field of Search ..... 482/35, 37; 472/75, 472/81, 136; D21/191, 245, 242; D25/151; 52/89, 64, 506

[56] References Cited

U.S. PATENT DOCUMENTS

| | | | |
|---|---|---|---|
| 796,159 | 8/1905 | Smolik | 482/35 |
| 1,380,730 | 6/1921 | Miller | 472/136 |
| 4,546,965 | 10/1985 | Baxter et al. | 482/35 |
| 5,092,587 | 3/1992 | Ulner et al. | 482/37 |

FOREIGN PATENT DOCUMENTS

| | | | |
|---|---|---|---|
| 871958 | 7/1949 | Fed. Rep. of Germany . | |
| 3905471 | 8/1990 | Fed. Rep. of Germany | 482/37 |
| 1501409 | 11/1967 | France . | |
| 2329306 | 5/1977 | France . | |
| 2570951 | 4/1986 | France . | |
| 1369682 | 10/1974 | United Kingdom . | |

*Primary Examiner*—Richard J. Apley
*Assistant Examiner*—Jeanne M. Mollo
*Attorney, Agent, or Firm*—Oliff & Berridge

[57] ABSTRACT

A modular rough surface of a climbing wall is formed by an assembly of elementary panels having specific curved structures, and arranged in a plurality of levels. The projection of the different panels on the rear plane parallel to the fixed support gives identical projected surfaces in the form of squares, or any other inscribed polygon. The side edges of the panels comprise a first profile associated with a first level difference, and/or a second profile associated with a second level difference. Assembly of the panels is performed with consecutive edges of the same profiles and level differences.

9 Claims, 12 Drawing Sheets

| | | | | | | | |
|---|---|---|---|---|---|---|---|
| | 0 | 0 | 0 | 0 | 1h | 2h | 4h |
| A1 | 1 | 2 | 1 | 2 | 10G | 13D | |
| | 0 | 1h | 1h | 0 | 1h | 3h | 4h |
| A2 | 2 | 3 | 1 | 10G | 12D | 11 | |
| | 0 | 1h | 0 | 0 | 2h | 2h | 3h |
| A3 | 11 | 10D | 0 | 6 | 1 | 4 | |
| | 1h | 0 | 0 | 0 | 2h | 3h | 2h |
| A4 | 3 | 13G | 2 | 12D | 11 | 11 | |
| | 2h | 2h | 1h | 1h | 1h | 2h | 1h |
| A5 | 1 | 11 | 2 | 12D | 11 | 11 | |
| | 2h | 3h | 2h | 2h | 0 | 1h | 0 |
| A6 | 11 | 11 | 1 | 13G | 3 | 2 | |
| | 3h | 4h | 3h | 2h | 1h | 1h | 0 |
| A7 | 3 | 13D | 11 | 11 | 2 | 1 | |
| | 4h | 4h | 2h | 1h | 0 | 0 | 0 |
| A8 | 12D | 10G | 2 | 2 | 1 | 2 | |
| | 5h | 3h | 2h | 1h | 0 | 1h | 1h |
| | B1 | B2 | B3 | B4 | B5 | B6 | |

FIG.18

ARTIFICIAL CLIMBING WALL WITH MODULAR ROUGH SURFACE

BACKGROUND OF THE INVENTION

The invention relates to an artificial structure, notably for a climbing wall, comprising:

a plurality of elementary panels of conjugate shapes, assembled to one another by removable fixing means to form a modular surface, the configuration of which is modifiable after recomposition of the panels, and means for connecting the modular surface to a fixed support, notably a wall or scaffolding.

In the former art, it is known to achieve modular structures by juxtaposition of prefabricated volumes (FR-A 2,467,609) or panels with flat faces (FR-A 2,592,588).

According to the document FR-A 2,607,018, juxtaposition of the plates forms a plurality of planes on the climbing surface, which is connected to a wall or scaffolding by interchangeable connecting bars.

The object of the invention is to achieve an artificial climbing wall with a modular rough surface made up from standard elements.

SUMMARY OF THE INVENTION

The artificial structure according to the invention is characterized in that the panels have specific curved structures, having identical projected surfaces in the form of inscribed polygons, notably a square, an equilateral triangle, or a hexagon, and side edges comprising at least a first profile associated with a first level difference h, and/or a second profile associated with a second level difference 2h, assembly of the panels being achieved with consecutive edges of the same profiles and level differences to obtain a modular rough surface arranged according to a plurality of levels h, 2h, 3h, 4h, and so on, with constant staggering.

The composition of the rough surface is made up from eighteen types of panels with square projections, a first panel of which constituting the plane element.

The panels constituting the rough surface comprise a first group of four panels belonging to the first level difference h, a second group of four panels with second profile edges belonging to the second level difference 2h, and a third group of nine panels with first and/or second profile edges belonging to the first and/or second level differences h, 2h, said panels of the third group being arranged to connect panels of the first and second groups together. Panels of the rough surface comprise straight edges located at predetermined levels.

BRIEF DESCRIPTION OF THE DRAWINGS

Other advantages and features will become more clearly apparent from the following description of an illustrative embodiment of the invention, given as a non-restrictive example only and represented in the accompanying drawings, in which:

FIG. 18 shows the projection on the vertical rear plane of the climbing wall according to FIG. 1;

DESCRIPTION OF THE PREFERRED EMBODIMENT

Figure 1:
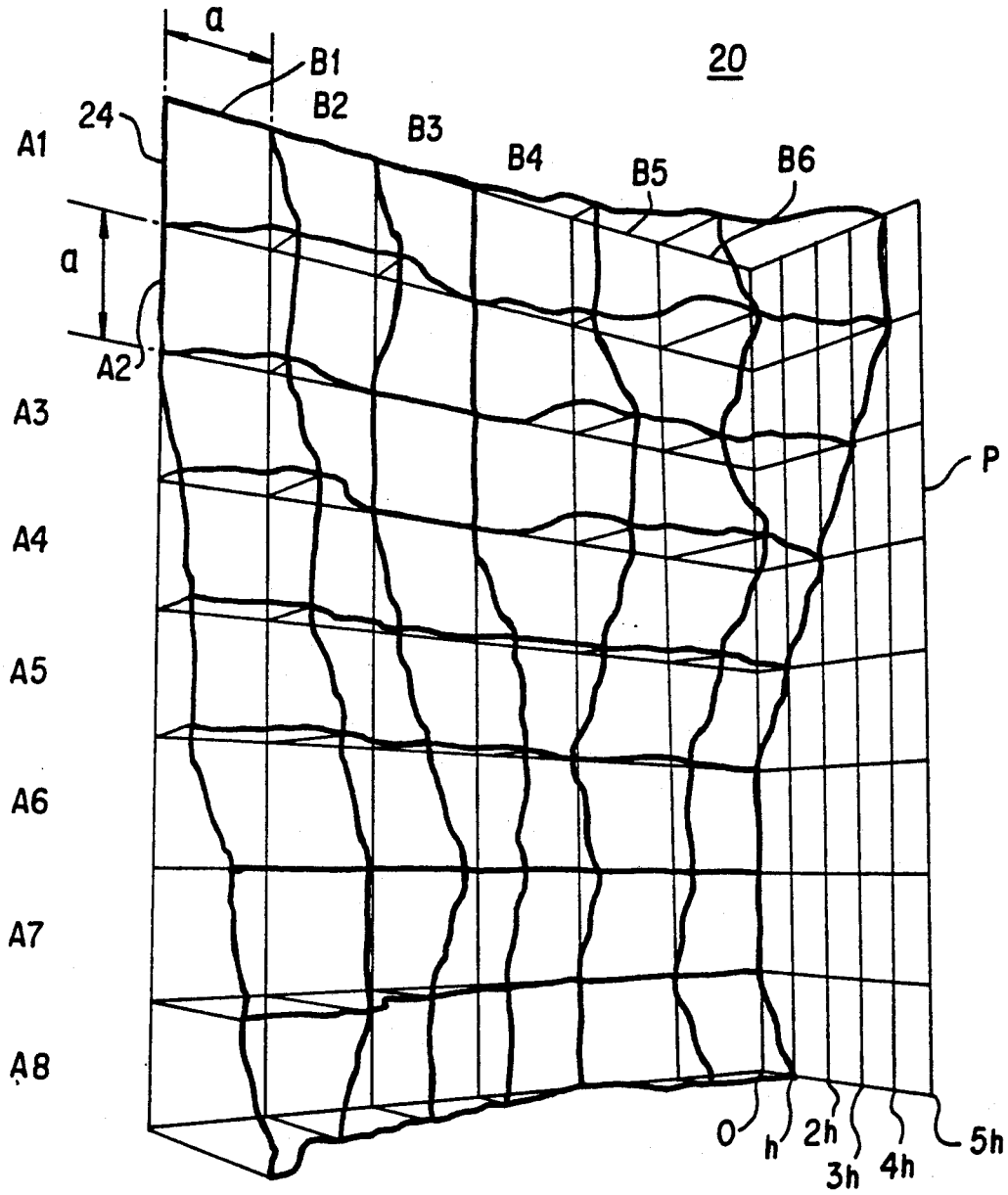
FIG. 1 is a perspective orthogonal projection view of a climbing wall according to the invention.
Figure 3:
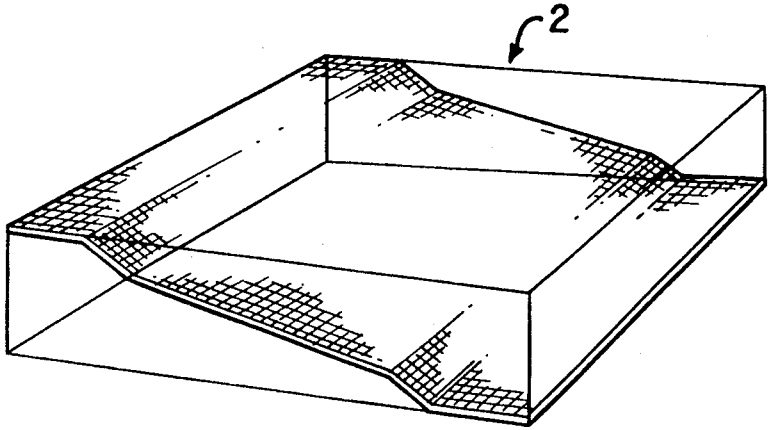
FIGS. 2 to 5 represent in perspective the four elementary pan of the first group.
Figure 5:
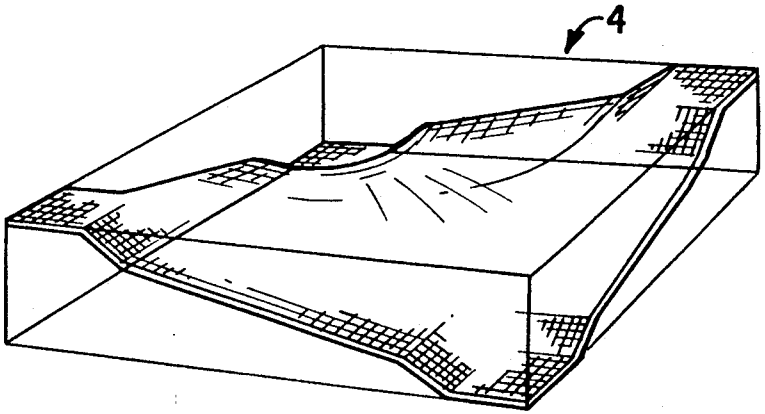
Figure 2:
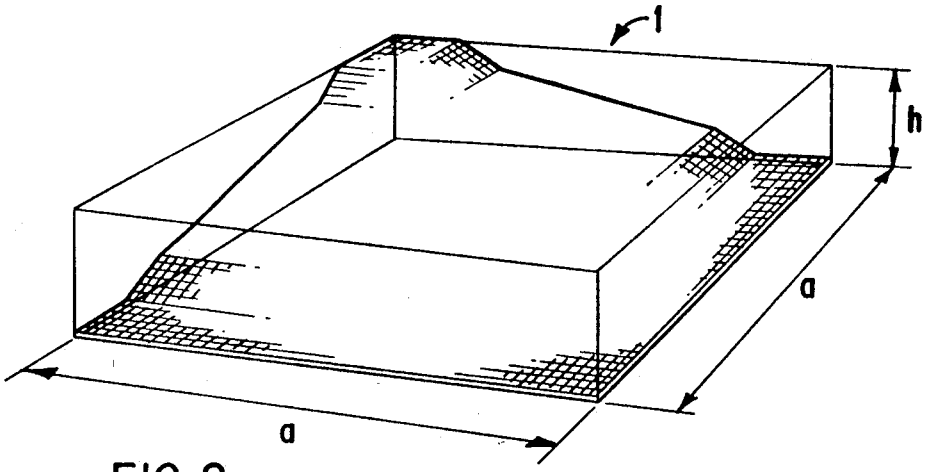
Figure 4:
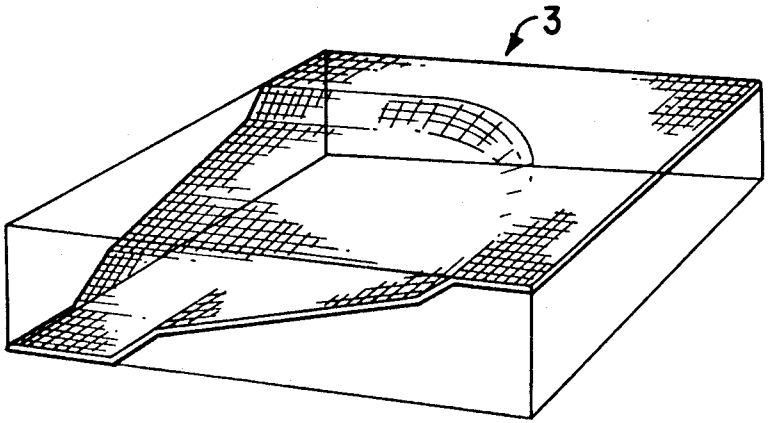
Figure 7:
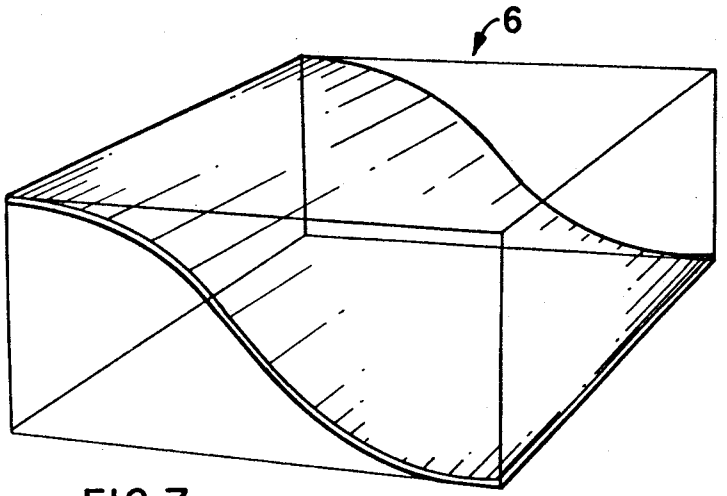
FIGS. 6 to 9 are identical views to FIGS. 2 to 5, and show the four elementary panels of the second group.
Figure 6:
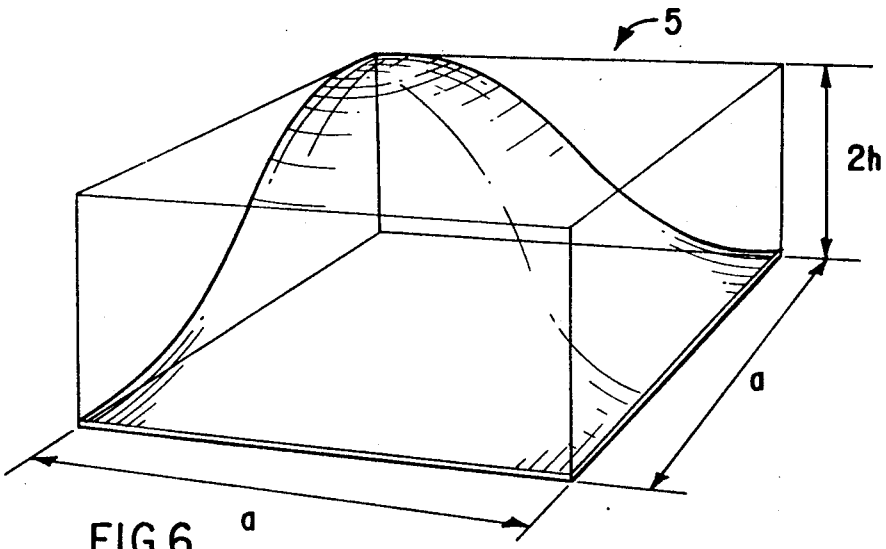
Figure 9:
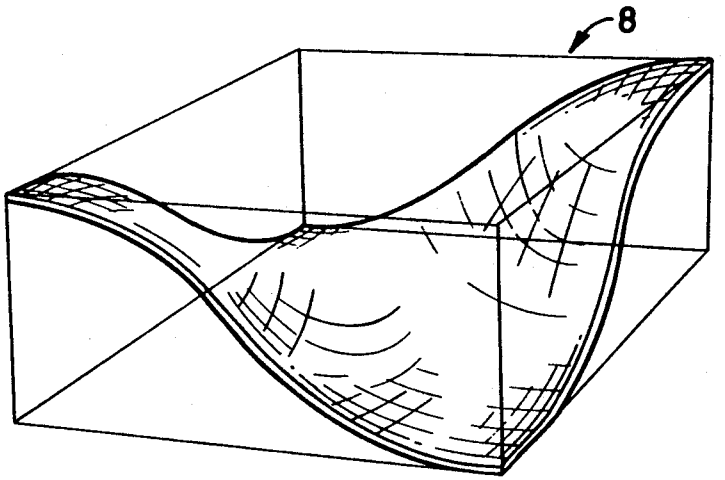
Figure 8:
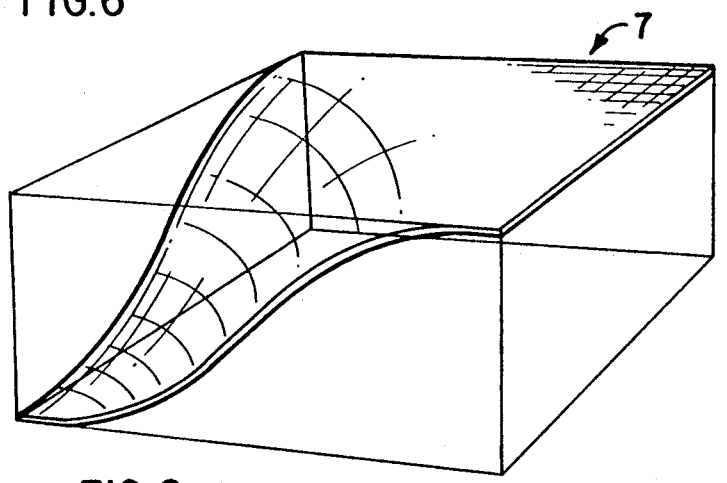

Referring to the figures, an artificial climbing wall comprises a modular rough surface 22 formed by assembly of a plurality of removable prefabricated panels 0 to 8, 10D, 10G, 11, 12D, 12G, 13D, 13G, 14, 15 each having a predetermined curved structure some of which are represented in FIGS. 2 to 13. The juxtaposition of the different elementary panels is interchangeable so as to enable the configuration of the rough surface 22 to be modified by a simple recomposition of panels.

The apparent curved structure of each standard panel 0 to 8, 10D,(10G, 11, 12D, 12G, 13D, 13G, 14, 15 is equipped with holds (not shown) comprising either hollow or prominent sculptures cast with the panel, or removable holds secured to the panel by means of fixing screws or bolts.

The rough surface 22 is securedly united via the rear to a fixed support 24 by means of a metal connecting framework 26 (FIG. 21) equipped with tubular bars.

The fixed support 24 is formed by an existing wall 28, on which profiled rails 30 are placed to fix the bars of the framework 26, but it is clear that any other supporting structure can be used, notably a scaffolding system.

The orthogonal projection of the rough surface 22 on the vertical rear plane parallel to the wall 24 (FIG. 1), and on the front plane P renders the surface discrete in two perpendicular directions. The breakdown of the surface projected on the rear plane generates a succession of identical regular frames of equal square bases of dimension a, arranged in several rows A1, A2, A3, A4, A5, A6, A7, A8 and columns B1, B2, B3, B4, B5, B6.

Other inscribed polygons can also be used as alternatives, notably equilateral triangles or hexagons.

On the front plane P the different successive levels h, 2h, 3h, 4h appear to make the slopes or incline of the curved structure of the different panels discrete with respect to the vertical rear plane. The staggering of the successive levels is constant and is fixed for example at 25 cm.

The composition of the rough surface 22 is made up from eighteen panels with square projections of dimensions a, composed with two level differences or slices h and 2h (FIGS. 2 to 13, and 17).

The first panel 0 of the top row (FIG. 17) constitutes the square plane element at zero level.

A first group of panels 1, 2, 3 and 4 of the second row (FIG. 17) corresponds to the first level difference h (25 cm), associated with the following respective combinations:

| | | | | |
|---|---|---|---|---|
| (1) | h | 0 | 0 | 0 |
| (2) | h | h | 0 | 0 |
| (3) | h | h | 0 | h |
| (4) | h | 0 | h | 0 |

whose curved surfaces are represented in FIGS. 2 to 5. The first column of the matrix above indicates the respective level (h, h, h, h) corresponding to the level of the upper left hand corner of the panels 1, 2, 3, 4. The second column indicates the respective levels (o, h, h, o) corresponding to the level of the lower left hand corner of the same panels. The third column indicates the respective levels (o, o, o, h) corresponding to the level of the lower right hand corner of the same panels. The fourth column indicates the respective levels (o, o, h, o) corresponding to the level of the upper right hand corner of the same panels. The rows correspond with an individual panel. Panel 1 of FIG. 2 comprises two adjacent straight edges situated at the same level 0, and two other adjacent profiled edges extending from level 1 to level 0. Panel 2 (FIG. 3) has two opposite straight edges situated one at level 0, and the other at level h, and two opposite profiled edges extending between levels h and 0. Panel 3 (FIG. 4) is the symmetry of panel 1. Panel 4 (FIG. 5) is shaped as a horse saddle comprising four profiled edges of the same level difference h. The first profile of the profiled edges associated with panels 1, 2, 3 and 4 presents a predetermined shape, for example a symmetrical broken line.

A second group of four panels 5, 6, 7 and 8 of the third row (FIG. 17) corresponds to the second level difference 2h (50 cm) having the following respective combinations:

| | | | | |
|---|---|---|---|---|
| (5) | 2h | 0 | 0 | 0 |
| (6) | 2h | 2h | 0 | 0 |
| (7) | 2h | 2h | 0 | 2h |
| (8) | 2h | 0 | 2h | 0 |

whose curved surfaces are represented in FIGS. 6 to 9. Again, the columns of the above matrix, for the second group of panels 5, 6, 7, 8 correspond with the level which corresponds with a particular corner of the third row of panels in FIG. 17. Again, the first column (2h, 2h, 2h, 2h) indicates the level corresponding with the upper left hand corner of the four panels 5, 6, 7, 8. The second column corresponds with the level of the lower left hand corner, the third column with the lower right hand corner and the fourth column with the upper right hand corner of the panels. In this case, the second profile of the profiled edges is a portion of a sinusoid. It is clear that any other profile can be chosen for the profiled edges of the first and second groups of panels 1 to 8.

Figure 17:
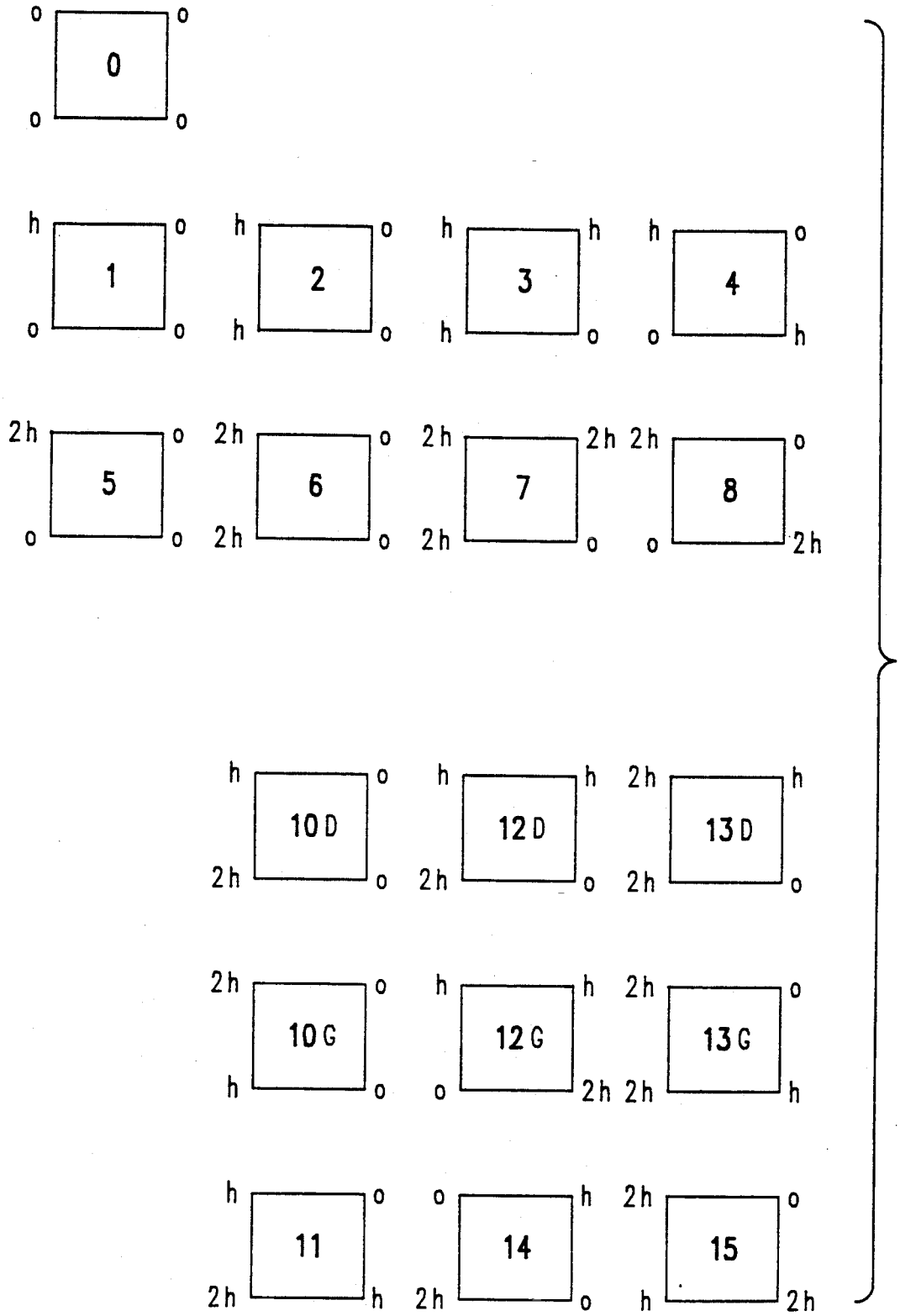
FIG. 17 is a schematic view of each of the 18 panels with square projections.

A third group of nine other panels 10D, 12D, 13D, 10G, 12G, 13G, 11, 14, 15 of the last three rows of FIG. 17 enables panels 1, 2, 3, 4 of the first group associated with the first level difference h to be connected to panels 5, 6, 7, 8 of the second group associated with the second level difference 2h. The nine panels of the third group correspond to the following combinations:

| | | | | |
|---|---|---|---|---|
| (10D) | h | 2h | 0 | 0 |
| (12D) | h | 2h | 0 | h |
| (13D) | 2h | 2h | 0 | h |
| (10G) | 2h | h | 0 | 0 |
| (12G) | h | 0 | 2h | h |
| (13G) | 2h | 2h | h | 0 |
| (11) | h | 2h | h | 0 |
| (14) | 0 | 2h | 0 | h |
| (15) | 2h | h | 2h | 0 |

The columns of the matrix for the third group of panels 10D, 12D, 13D, 10G, 12G, 13G, 11, 14, 15 correspond to the same panel corner location as previously described for the preceding matrices.

Figure 10:
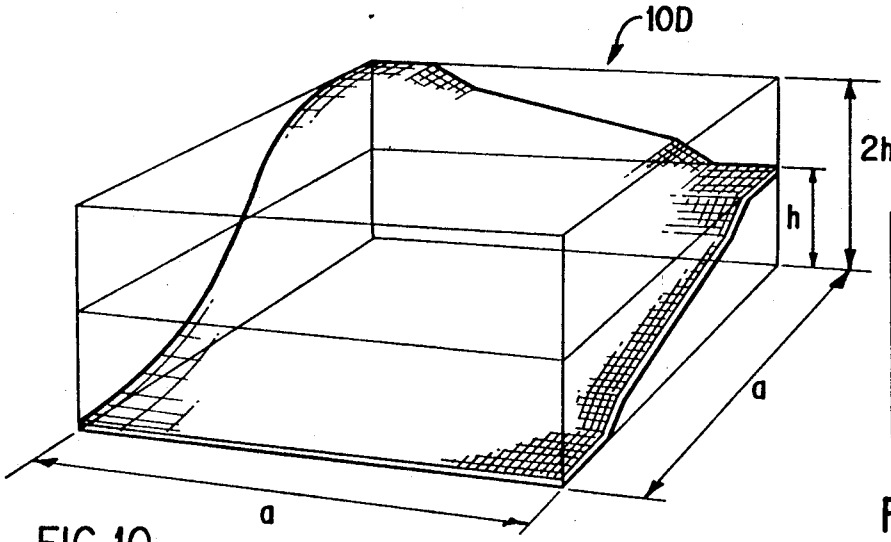

In FIG. 10, panel 10D presents a straight edge of level 0, two adjacent profiled edges with a first broken line profile, and a profiled edge with the second sinusoidal profile.

Figure 11:
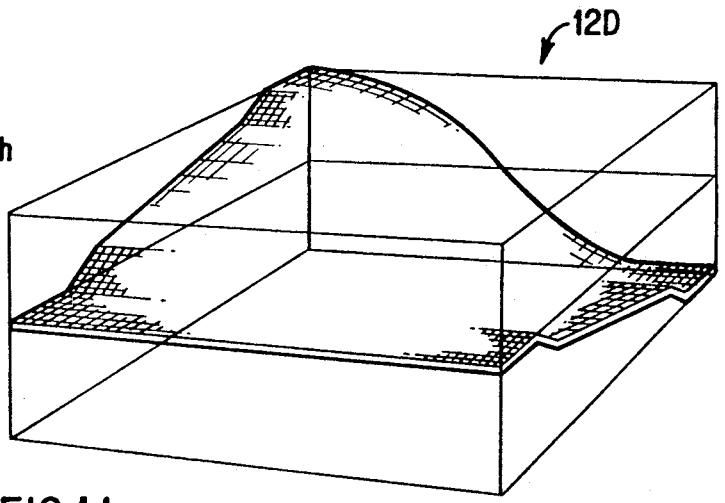
FIGS. 10 to 13 show some elementary panels of the third group.

In FIG. 11, panel 12D comprises a straight edge situated at level h, two opposite profiled edges with a first broken line profile, and a profiled edge with the second sinusoidal profile.

Figure 13:
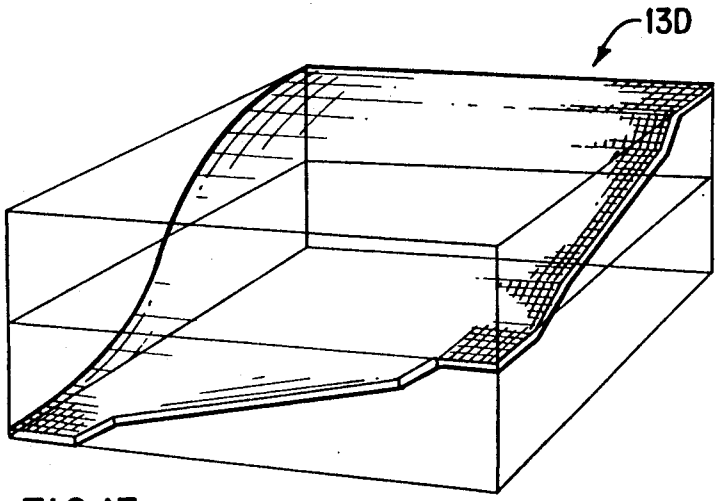

In figure 13, panel 11 has four profiled edges of the first profile extending between levels 0, h, 2h.

Figure 12:
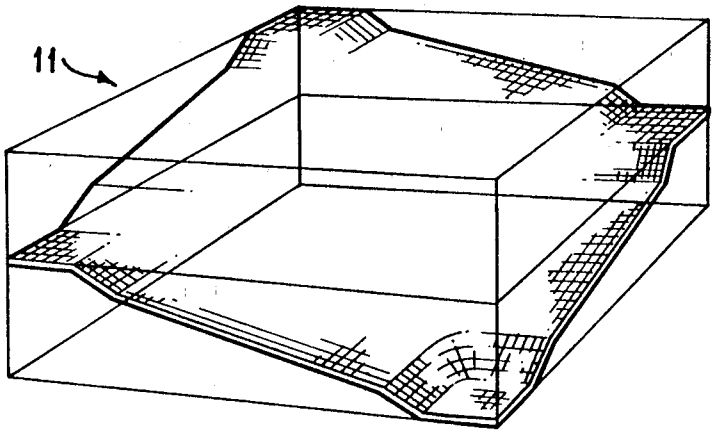

Panel 13D in FIG. 12 has a straight edge situated at level 2h, two adjacent profiled edges with the first profile extending between levels 0, h, 2h, and a profiled edge with the second sinusoidal profile.

The perspective structure of the remaining panels 10G, 12G, 13G, 14 and 15 of the third group can easily be deduced from the above combination table, and from the projected representation of FIG. 17.

Figure 14:
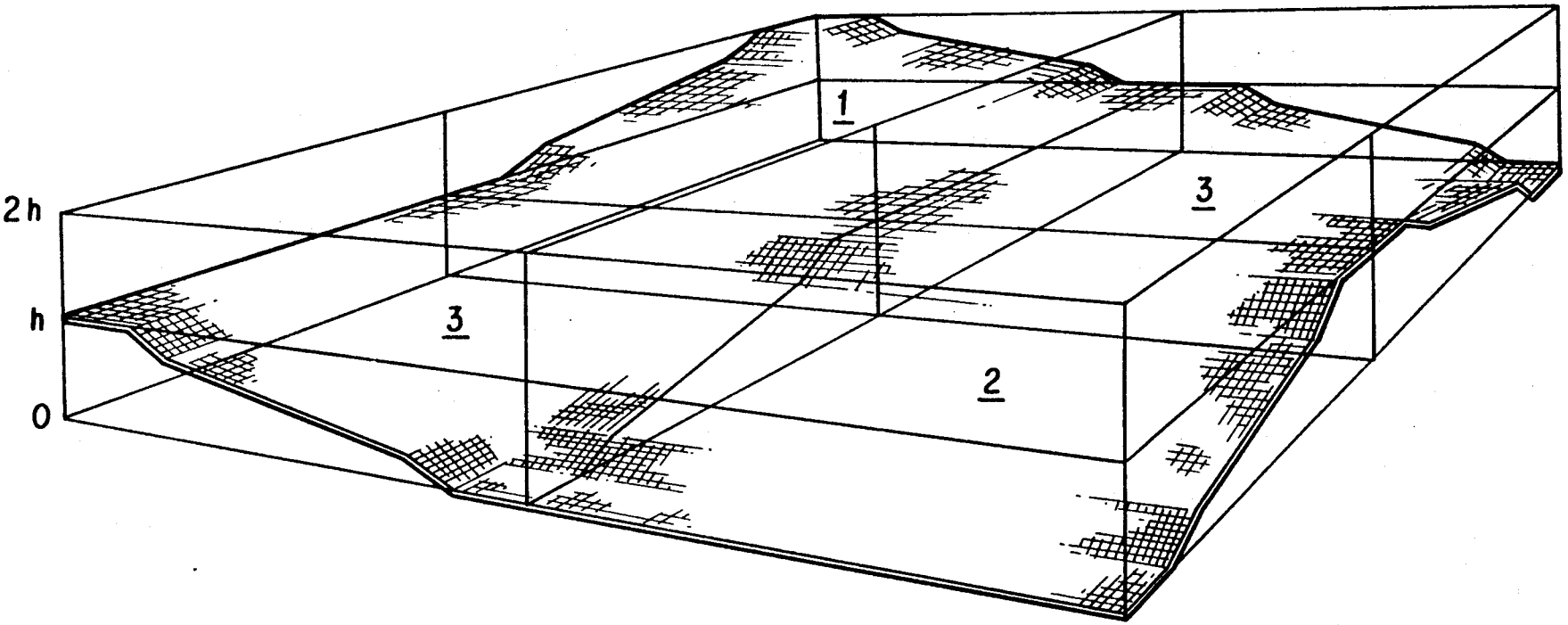
FIG. 14 represents a perspective view of an assembly with two levels of panels of the first group.

FIG. 14 shows an assembly of four panels 1, 3, 2, 3 of the first group arranged on three levels 0, h, 2h. The edges of two adjacent panels must in order to join have the same straight or broken line profile and the same level or the first level difference h.

Figure 15:
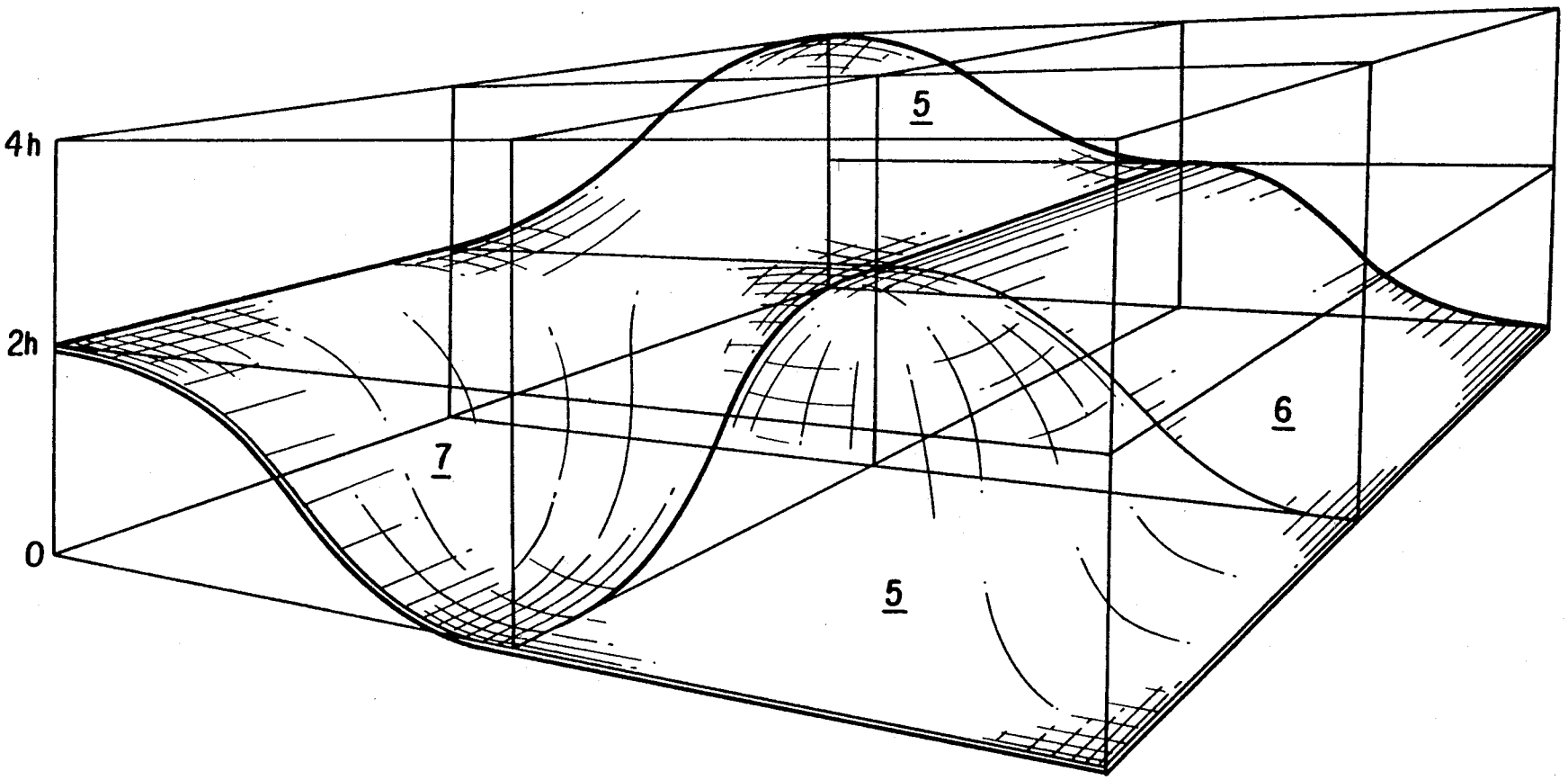
FIG. 15 is an identical view to FIG. 14 with an assembly with two levels of panels of the second group.

FIG. 15 represents an assembly of four panels 5, 7, 5, 6 of the second group arranged on three levels 0, 2h, 4h. The abutting edges of two consecutive panels must have the same straight or sinusoidal profile and the same level or the second level difference 2h.

Figure 16:
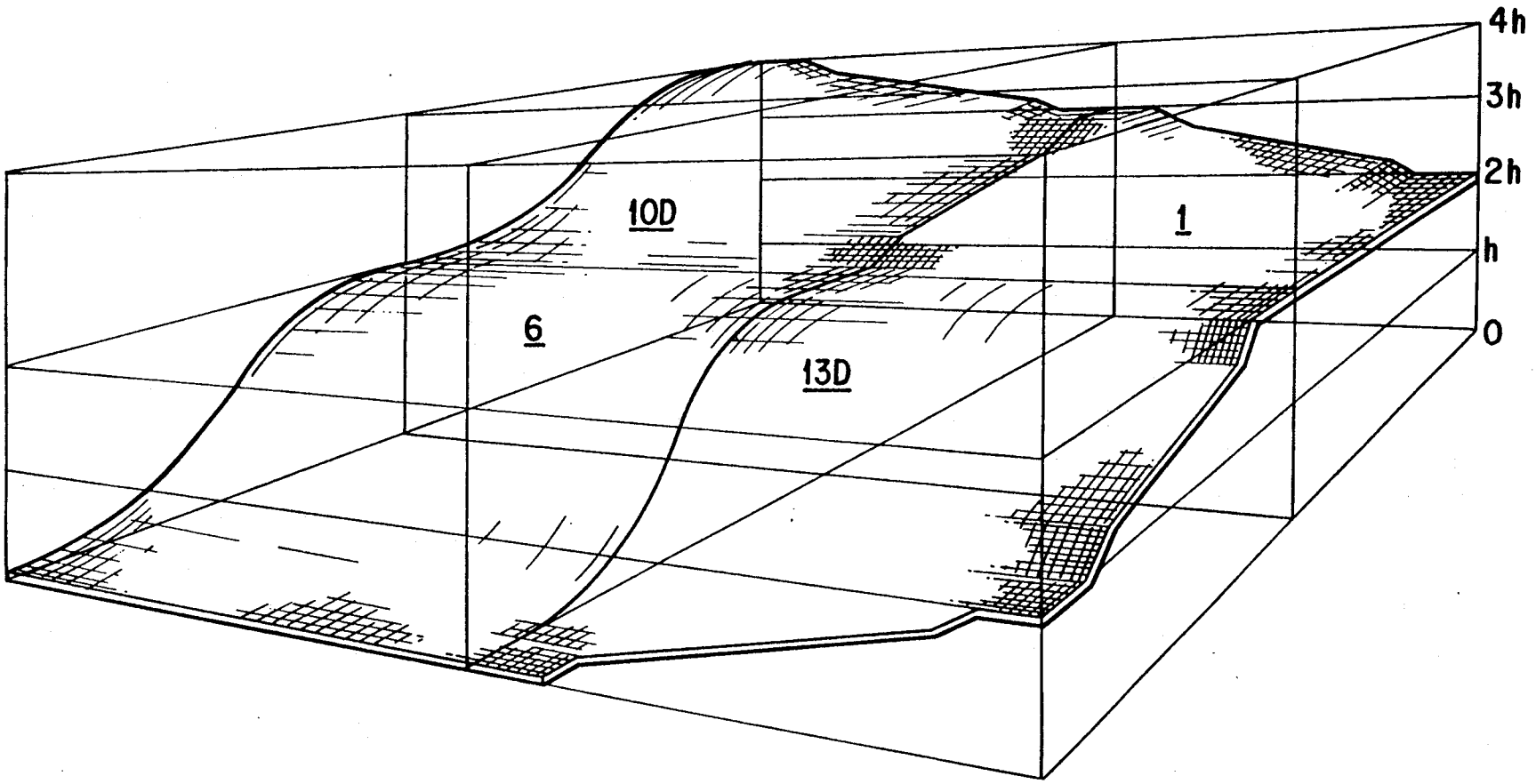
FIG. 16 shows an assembly with four levels of panels of the first, second and third groups.

FIG. 16 shows an assembly of four panels 10D, 6, 13D, 1 belonging to the three groups, arranged on five levels 0, h, 2h, 3h, 4h.

In FIGS. 1 to 18, the specific arrangement of the panels in columns B1 to B6 of the rough surface 22 of the climbing wall 20 enables different slopes, gradients, declivities or overhangs to be obtained with a succession of five levels h, 2h, 3h, 4h, 5h.

Assembly of the different elementary panels is performed with edges of the same profile, and of the same level or level difference.

Figure 19:
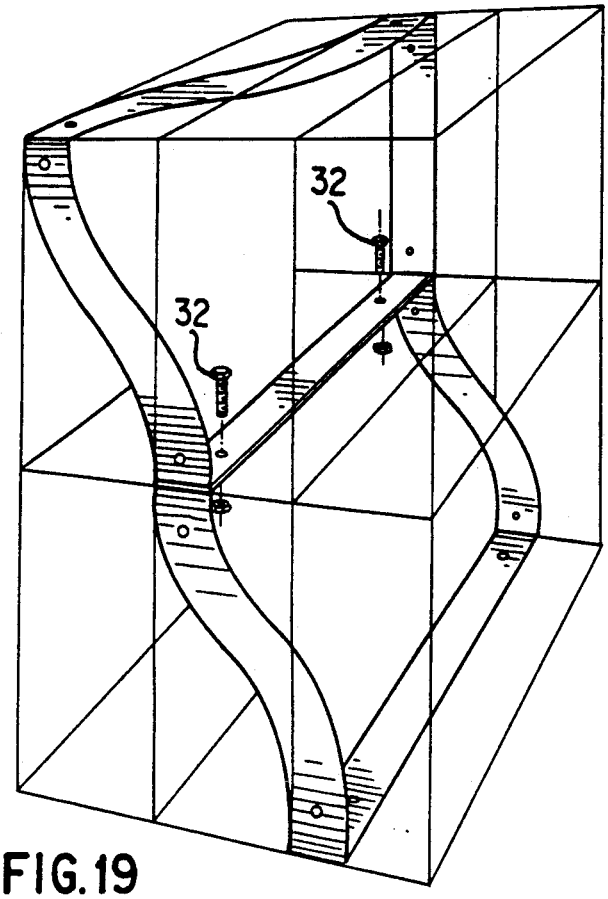
FIG. 19 represents a first assembly mode of two consecutive panels.

Referring to FIG. 19, each panel comprises an edge parallel to the projection direction enabling the panels of any one column to be stacked. Mechanical fixing of two consecutive panels is then performed by means of bolts 32.

Figure 20:
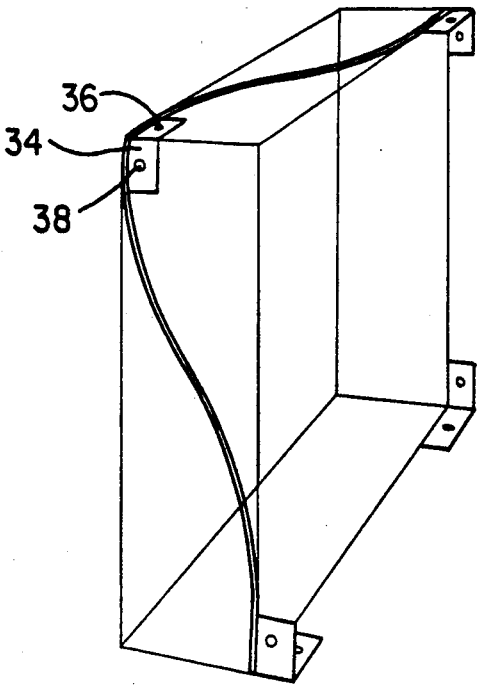
FIG. 20 shows a panel equipped with fixing brackets for a second assembly mode.

According to an alternative embodiment (FIG. 20), each panel edge is equipped in a rear portion with a symmetrical L-shaped bracket 34, each flange of which comprises a hole 36, 38 for a fixing screw to pass through.

Figure 21:
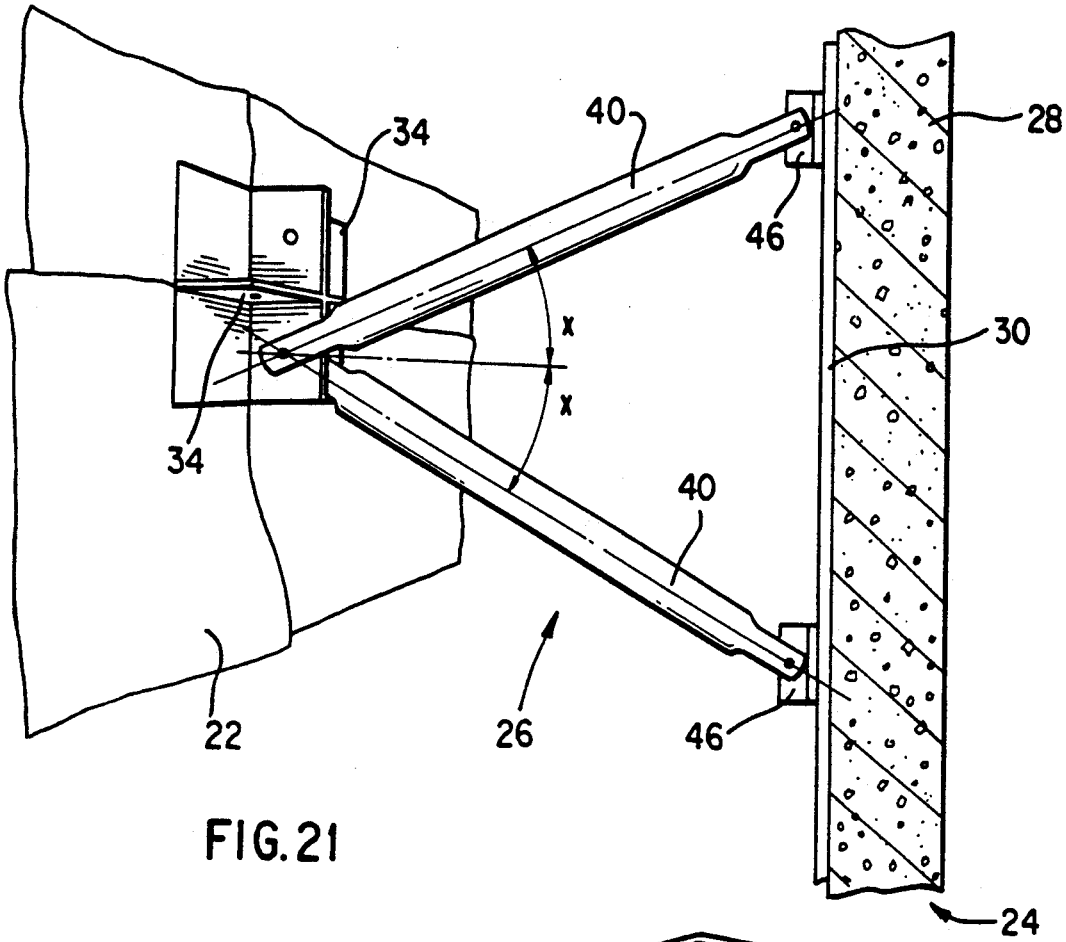
FIG. 21 represents a part of the framework connecting the rough surface to the fixed wall.
Figure 22:
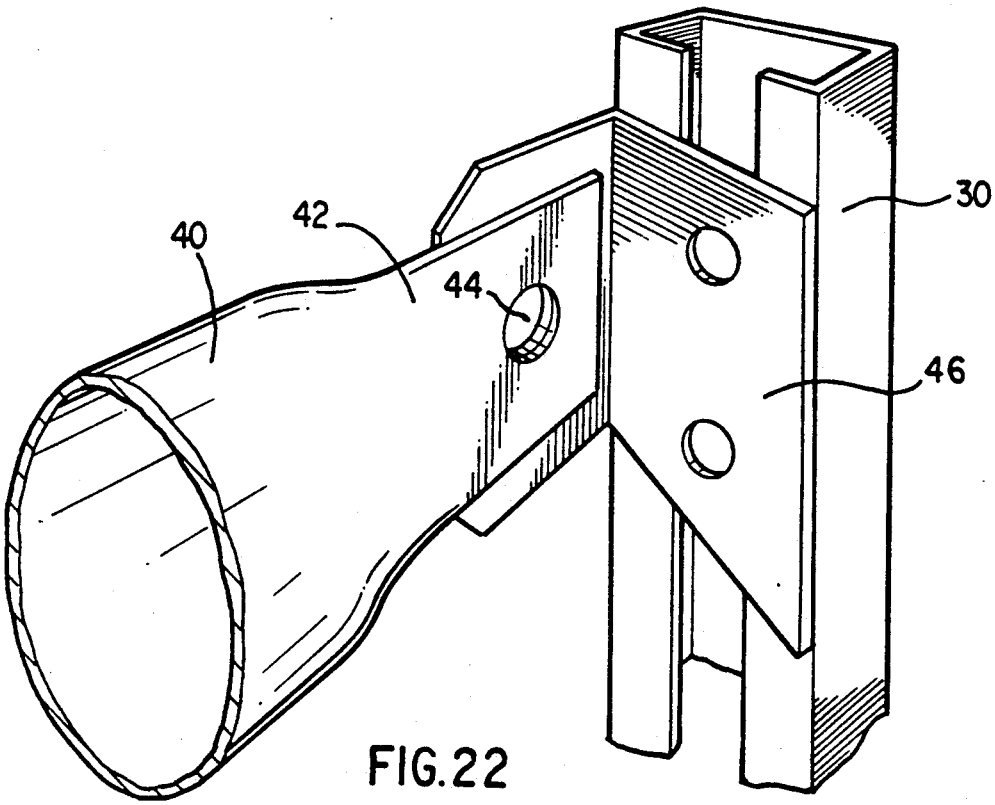
FIG. 22 shows on an enlarged scale a detail of FIG. 21, concerning fixing of a tube onto a wall rail.

In FIGS. 21 and 22, the connecting framework 26 between the panels of the rough surface 22 and the wall 28 comprises standard bars in the form of tubes 40. Each tube 40 is squashed at both ends so as to present two opposite bearing surfaces 42 of plane structures, one of which is represented in FIG. 22.

One of the bearing surfaces 42 of each tube 40 is fixed on the panel side to a bracket node 34, whereas the other bearing surface 42 is securedly united by bolts 44 to a fixing plate 46, bolted onto the corresponding profiled rail 30. This results in the framework 26 being able to be assembled quickly.

Each fixing point of a bracket node 34 has associated with it a pair of tubes 40 of the same lengths, each forming an acute angle x with the perpendicular to the wall 28. Such an arrangement of the tubes 40 as an isosceles triangle enables the stresses of the framework 26 to be taken up without passing via the panels. The choice of the angle x depends on the stresses permissible in the tubes 40.

Figure 23:
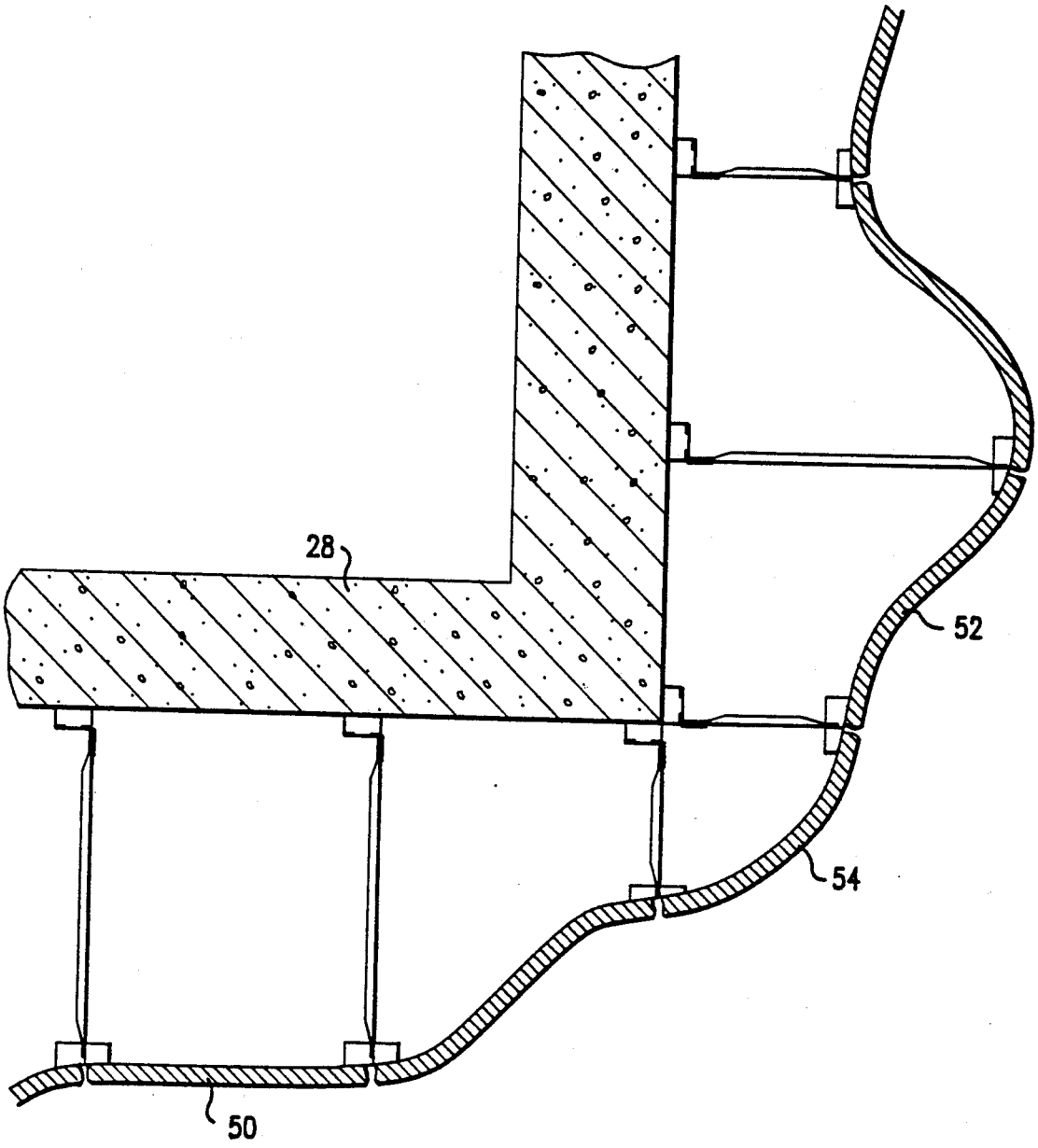
FIG. 23 represents an element for connecting two rough surfaces with orthogonal projections.

In FIG. 23, joining of two rough surfaces 50, 52 of orthogonal projections is achieved by means of connecting parts 54 capable of obtaining closed surfaces.

The invention is naturally in no way limited to an artificial climbing wall, but extends to any other construction of modular rough structure.

I claim:

1. An artificial structure for a climbing wall, comprising:

a plurality of elementary panels of conjugate standard shapes, assembled to one another by removable fixing means to form a modular surface, whose configuration is modifiable after recomposition of the panels, means for connecting the modular surface to a fixed support extending parallel to a vertical rear plane, said panels having specific curved structures, wherein when said plurality of elementary panels projects on said vertical rear plane a succession of identical regular frames of equal projected surfaces in the form of inscribed polygons is generated, arranged in several rows and columns said panels having side edges, said side edges having profiles and level differences, and said side edges comprising at least one of a first profile associated with a first level difference and a second profile associated with a second level difference, wherein assembly of said panels having different specific curved structures is achieved by having said profiles and level differences of consecutive side edges being the same to obtain a modular rough surface being a curved surface arranged according to a plurality of levels, with constant staggering, said plurality of levels appearing on a front plane extending perpendicular to said rear plane, said modular rough surface comprising a first group of panels belonging to the first level difference, a second group of panels with second profile edges belonging to the second level difference, and a third group of panels with at least one of a first and second profile edge belonging to the first and second level differences, wherein said panels of the third group are arranged to connect panels of the first and second groups together.

2. The artificial structure according to claim 1, wherein the composition of the rough surface is made up from eighteen types of panels with square projections, comprising a first panel being a plane element having a straight line profile and a zero level, and said first, second and third groups having respectively four, four and nine panels, said panels each comprising straight edges arranged at predetermined levels.

3. The artificial structure according to claim 1, wherein the first profile of the side edges is formed by a symmetrical broken line.

4. The artificial structure according to claim 1, wherein the second profile of the side edges is formed by a portion of a sinusoid.

5. The artificial structure according to claim 1, wherein each said side edge extends in a parallel direction to a projection on the vertical rear plane which enables the panels of any one column to be stacked.

6. The artificial structure according to claim 5, wherein each side edge has a rear portion having a bracket comprising two flanges with holes for screws to pass through, said bracket having a symmetrical L-shaped structure for enabling said recomposition of said panels.

7. The artificial structure according to claim 6, wherein said means for connecting the modular rough surface to said fixed support comprise tube-shaped bars, each said bar having opposite first and second ends, said first end comprising a flat bearing surface which is fixed to a bracket node on said panel, and said second end having a second flat bearing surface which is secured to a fixing plate, said fixing plate being bolted onto a profiled rail which is vertical to said fixed support and wherein each bracket node is connected to a pair of said bars being of a same length and each of said bar forming an acute angle with a perpendicular to said fixed support, so as to form an isosceles triangle enabling stresses to be taken up.

8. The artificial structure according to claim 1, wherein said fixed support is a wall.

9. The artificial structure according to claim 1, wherein said fixed support is a scaffolding.

* * * * *